US005568967A

United States Patent [19]

Sikkens et al.

[11] Patent Number: 5,568,967

[45] Date of Patent: Oct. 29, 1996

[54] ELECTRIC LAMP WITH REFLECTOR

[75] Inventors: Marten Sikkens; Johannes P. M. Ansems, both of Eindhoven, Netherlands

[73] Assignee: U.S. Philips Corporation, New York, N.Y.

[21] Appl. No.: 416,276

[22] Filed: Apr. 4, 1995

[30] Foreign Application Priority Data

Apr. 8, 1994 [EP] European Pat. Off. ..... 94200960

[51] Int. Cl.[6] ..... F21V 5/00

[52] U.S. Cl. ..... 362/328; 362/297; 362/346; 362/348; 362/255

[58] Field of Search ..... 362/328, 255, 362/267, 297, 327, 329, 346, 348, 261

[56] References Cited

U.S. PATENT DOCUMENTS

| | | | |
|---|---|---|---|
| 4,021,659 | 5/1977 | Wiley | 240/41.36 |
| 4,456,948 | 6/1984 | Brun | 362/328 |
| 4,829,407 | 5/1989 | Bushell et al. | 362/29 |
| 4,929,863 | 5/1990 | Verbeek et al. | 362/296 |
| 5,039,904 | 8/1991 | Kosmatka et al. | 362/267 |
| 5,192,124 | 3/1993 | Kawashima | 362/61 |
| 5,235,470 | 8/1993 | Cheng | 362/296 |

*Primary Examiner*—Denise L. Gromada
*Assistant Examiner*—Alfred Basichas
*Attorney, Agent, or Firm*—Brian J. Wieghaus

[57] ABSTRACT

The electric lamp with reflector has a concave reflecting surface of a rotationally-symmetric general shape, onto which flat four-sided facets are superimposed which are tangent to the general shape. The facets each illuminate a rectangular field in a plane perpendicular to the optical axis of the reflector, which fields are of equal shape and size and have the same orientation. Thereby, the electric lamp with reflector is able to illuminate a rectangular field with a high degree of uniformity and of efficiency. The electric lamp with reflector may be used in an image-projection apparatus.

28 Claims, 3 Drawing Sheets

ELECTRIC LAMP WITH REFLECTOR

BACKGROUND OF THE INVENTION

The invention relates to an electric lamp with reflector, comprising:

a reflector having a reflector body with a concave reflecting surface chosen from surfaces with an ellipsoidal and surfaces with a paraboloidal general shape, an optical axis, a focus within the reflector, and a light emission window;

an electric lamp with a lamp vessel which is closed in a vacuumtight manner and in which a linear electric element is present, arranged on the optical axis.

Such an electric lamp with reflector is described in the non-prepublished European Patent Application 93 20 29 51.5.

The known lamp with reflector may be used for projection purposes, such as film or slide projection, but also in projection TV devices. In these devices, as is the case with film or slide projection, a light-transmitting image carrier is present in a plane perpendicular to the optical axis of the reflector, for example, an LCD screen or a DMD (Digital Mirror Device) screen. Such image careers are usually rectangular, for example, with a width/height ratio of 4/3 or 16/9.

It is the aim of the electric lamp with reflector to illuminate the image carrier brightly and uniformly, so that an optical system, which may comprise a projection lens, is capable of displaying the image clearly and evenly on a screen, so that it can be viewed thereon.

The uniformity of illumination, however, may be adversely affected by an inaccurate placement of the electric element. Furthermore, the electric element may change its place, for example, owing to differences in expansion at high operating temperatures, or because a discharge arc acting as the light source has changing points of application on the electrodes.

The brightness of the illumination is adversely affected by the fact that the electric lamp with reflector provides a round illuminated field, whereas the image carrier is rectangular. A portion of the light is accordingly thrown outside the image carrier. This portion is greater in the case of a more elongate image carrier (16/9) than in the case of a carrier with a shape closer to the square shape (4/3).

U.S. Pat. No. 4,021,659 discloses an ellipsoidal reflector for projection purposes with an incandescent lamp just accommodated therein. The lamp has an incandescent body which is positioned axially. The reflecting surface of the reflector has superimposed facets which are arranged both in radial lanes and in circular bands. The reflector has retained its rotationally symmetrical shape owing to this arrangement of the facets, which are trapezium-shaped. The facets are all perpendicular to the radius with their parallel sides. They may have a convex surface. It is the object of the facets to increase the uniformity of the illumination of an illuminated field.

The facets throw enlarged images of the incandescent body superimposed over one another in the second focus. The photographs included in the cited Patent show that an illuminated field of improved homogeneity is obtained, which nevertheless is still patchy and which has a round shape.

SUMMARY OF THE INVENTION

It is an object of the invention to provide an electric lamp with reflector of the kind described in the opening paragraph with which a rectangular field DP in a plane P perpendicular to the optical axis can be illuminated uniformly and with an increased efficiency.

According to the invention, this object is achieved in that the reflecting surface is built up mainly from substantially plane, substantially quadrangular reflecting facets superimposed on the general shape, which facets each have a point of tangency to the concave general shape and each individually illuminate a field in a plane P at a distance from the light emission window, perpendicular to the optical axis, which field is substantially of the same shape and size for each facet and has the same orientation, and the light emission window has a diameter $D_{LS}$ and the electric element has an axial dimension L, $D_{LS}/L$ being greater than 40.

The term "general shape", or basic shape or overall shape, is used herein to indicate the shape the reflecting surface would have in case the superimposed facets were absent.

The invention is based inter alia on the recognition that basically a round field is illuminated when, for example, an ellipsoidal reflector with plane facets arranged in radial lanes and in circular bands is used. The facets generate images in the plane P which are rotated about the optical axis through an angle $\alpha$ relative to one another each time, moving in a circular band from lane to lane. The angle $\alpha=360°/n$, n being the number of lanes. This is clarified in FIG. 1 of the drawings.

In FIG. 1, a rectangular field DP is arranged concentrically with the optical axis 4. Facets provide quadrangular images over this field. The corner points of four coinciding images have been marked once. Adjoining facets and their images are rotated relative to one another through 360°/24=15° each time. The FIG. shows that there is a circular field to whose illumination all facets contribute and within which the illumination may be homogeneous. The illumination outside the circle is lost as being non-homogeneous. The light inside the circle, however, is also used only partly because only the field DP is utilized, which is smaller than the circle.

The measures taken in the electric lamp with reflector according to the invention to counteract this comprise the choice of the shape and size of the facets in dependence on their distance to the electric element such that the facets each illuminate a field in the plane P which substantially has the shape and size of the rectangular field DP. The measures also include that the fields illuminated by the facets have substantially the same position as the field DP, i.e. a substantially equal rotational position around the optical axis. It follows from this that the fields illuminated by the facets in plane P are substantially of equal shape and size and are substantially parallel to one line.

These measures have visually observable results for the axial aspect of the reflector. If the reflector (see FIG. 2) has facets with horizontal edges in a vertical plane V through the axis, then in a horizontal plane H through the axis the reflector will have horizontal edges of other facets or facets having a horizontal or substantially horizontal centreline. The latter depends on the size of the reflector and the size of the facets. The facets, accordingly, have the same orientation, as do the facets between said horizontal and said vertical plane. This is an essential difference with the reflector of the cited U.S. Pat. No. 4,021,659 in which the facets in the vertical plane are rotated through 90° relative to the facets in the horizontal plane. The facets of this known reflector have the same shape in both planes, and in between these planes, whereas the facets of the reflector according to the invention do not. Furthermore, the number of facets in the vertical plane is not equal to the number of facets in the horizontal plane, in contrast to the known reflector.

Another result is that the reflector according to the invention has non-faceted regions in between facets, in contrast to the known reflector in which the facets occupy the entire reflector surface area. The facets, even with the greatest possible packing density on the surface area of the reflector according to the invention, seemingly have a somewhat disorderly arrangement. It is possible for the facets to have extensions so as to fill the reflector entirely, but these extensions throw light outside the rectangular target area only and are not useful.

The invention is also partly based on the recognition that it is necessary for a high degree of uniformity of the illumination that the electric element, and thus the light source, should be small relative to the reflector. This is expressed in the minimum ratio between the diameter $D_{LS}$ of the light emission window and the axial length L of the electric element. Thus the electric element will have an axial length L of approximately 1.8 mm or less, preferably 1.5 mm or less, in the case of a diameter $D_{LS}$ of, for example, 75 mm. The element is then a quasi point source with $D_{LS}/L$ being 50 or more.

The electric lamp with reflector illuminates a rectangular field DP in plane P perpendicular to the optical axis uniformly and with an increased efficiency.

The electric element may be an incandescent lamp, for example, in a quartz glass lamp vessel, for example with a filling comprising halogen. Because of the high luminous efficacy and the high brightnesses which can be realised thereby, the electric element is preferably a discharge path, for example, in a quartz glass or ceramic lamp vessel, in an ionizable medium, whereby it is possible to generate a high-pressure discharge arc in that medium, for example between electrodes. The medium may be a rare gas, for example xenon, for example with a filling pressure of several bar, possibly with mercury added, for example with a working pressure of about 200 bar or more, and/or with metal halides.

It is favourable when the facets are tangent to the basic shape of the reflecting surface of the reflector substantially in their geometric centres, i.e. the points of intersection of their diagonals. This promotes a dense packing of the facets. The regions between facets may be, for example, light-absorbing, but in a favourable embodiment they are light-scattering. They are then usefully employed in that they add diffuse light to the illumination realized by the facets.

When the electric element is supplied through current conductors which enter the lamp vessel at opposing ends, it is advantageous to realize the lead-through of one conductor through an opening in the reflector body in such a region between facets. No or comparatively little primary useful reflecting surface area will be lost in that case.

If the reflector has a reflecting surface with an ellipsoidal general shape, the electric element may be positioned in the focal point inside the reflector. The fields illuminated by the various facets in the plane P then substantially coincide. If the reflector has a paraboloidal general shape, and the electric element is shifted from the focus towards the light emission window, then the reflector substantially behaves as an ellipsoid and the illuminated fields accordingly again coincide substantially. If the electric element is in the focus of a reflector of paraboloidal general shape, then a lens may be used for causing the illuminated fields to coincide in plane P. A lens, a condensor, is often already used in image projection systems for deflecting the light towards the image carrier and imaging it at the input aperture of a projection lens which displays the image on a screen.

The reflector may be made of metal, for example of aluminium, or alternatively, for example, of glass or synthetic resin which is provided with a reflecting surface, for example, with a layer of aluminium, silver, or gold, or with a light-reflecting dichroic mirror. The latter is favourable because of the comparatively high reflectivity which such a filter may have and because of the possibility of having undesirable radiation such as, for example, heat radiation pass through the filter.

It is favourable for the safety of the unit when the reflector body is closed off with a transparent plate. It can be prevented thereby that flammable objects come into contact with hot portions of the lamp. The risks involved in an explosion of the lamp vessel may also be reduced thereby. The transparent plate may be fixed to the reflector body with an adhesive, for example, silicone glue. Alternatively, however, the transparent plate may be fastened by mechanical means, for example, with a metal ring flanged around the reflector body. Instead of this, alternatively, a clamping ring or a number of clamps may be used. The transparent plate may also have an optical function, for example, be a colour correction filter or a positive lens, for example, for causing illuminated fields to coincide in plane P.

It is favourable to give the transparent plate an anti-reflection coating at one or both surfaces. It is achieved thereby that light losses owing to reflection at the relevant surface, which may amount to approximately 4% of the incident light, are reduced or substantially avoided. A surface may have a coating, for example, of a $\lambda/4$ layer of a material of low refractive index, for example 1.38, such as $MgF_2$. Alternatively, a coating of two layers may be used such as, for example, a $\lambda/4$ layer of high refractive index, for example n=1.70, with a layer of low refractive index disposed thereon. A multilayer coating may alternatively be used such as, for example, $\lambda 4$ with n=1.7, $\lambda/2$ with n=2.0 thereon, and $\lambda/4$ with n=1.38 thereon. A wavelength in the visible portion of the spectrum is chosen for $\lambda$ here, for example in the centre of this spectrum.

The electric lamp may be permanently joined to the reflector, or alternatively be exchangeably mounted therein.

The embodiment of the electric lamp with a reflector having a paraboloidal general shape in which the electric element is in the focus of the reflector has the advantage that the lamp with reflector may be readily adapted to specific choices made by a manufacturer of the projection equipment in which the lamp with reflector is used. Reference is made to FIGS. 3 and 4 here.

FIG. 3 shows the basic principle of a projection apparatus. A lamp with a reflector S throws a light beam onto a field lens FL in plane P. Behind this there is an image carrier IC and at a distance therefrom a projection lens PL. The field lens FL converges the light towards the projection lens PL. The image carrier IC imparts image information on the beam. The projection lens PL forms an image of the image carrier on a projection screen PS a considerable distance away.

It is explained with reference to FIG. 4 how an extra lens EL, for example in the light emission window, in the case of a faceted reflector with paraboloidal general shape adapts the lamp with reflector to the projection apparatus, especially to the projection lens PL used therein. The facets of the reflector LS reflect light coming from the focus F and spread this light most strongly in the plane of the diagonal of a facet. The light is converged by the extra lens EL towards the field lens FL in plane P in which the rectangular field DP is depicted with its diagonal dimension. The field lens converges the light through the image carrier IC, shown with its diagonal dimension in the Figure, towards the projection lens PL.

Parallel light rays a, b and c coming from corresponding corner points of various facets are brought together in the focal plane of extra lens EL. The field lens FL is situated in that focal plane.

Accordingly, it holds for the focal distance $F_{EL}$ of EL:

$$x=F_{EL} \quad (1)$$

The projection lens PL makes an image at a considerable distance away, such that the following holds for the focal distance $F_{PL}$ of PL:

$$y=F_{PL} \quad (2)$$

The diameter $D_{EL}$ of the extra lens EL must be so great that all the light from the lamp with reflector LS is thrown on the projection lens PL with diameter $D_{PL}$. The lines p and q show that $$D_{EL}/D_{PL}=x/y \quad (3)$$

It follows from (1), (2) and (3) that an extra lens must be chosen for adapting the lamp with reflector to the projection apparatus such that $$F_{EL}=F_{PL}\cdot D_{EL}/D_{PL} \quad (4)$$

It is also found to be favourable, in order to keep the optical axis of the apparatus as short as possible and give the extra lens the smallest possible diameter, to have $D_{EL}$ be equal to $D_{LS}$, and thus to incorporate the extra lens in the light emission window of the reflector, so that $$F_{EL}=F_{PL}\cdot D_{LS}/D_{PL} \quad (5)$$

BRIEF DESCRIPTION OF THE DRAWINGS

The invention will be explained in more detail and an embodiment of the lamp with reflector according to the invention is shown in the drawing, in which.

DESCRIPTION OF THE PREFERRED EMBODIMENTS

Figure 5:
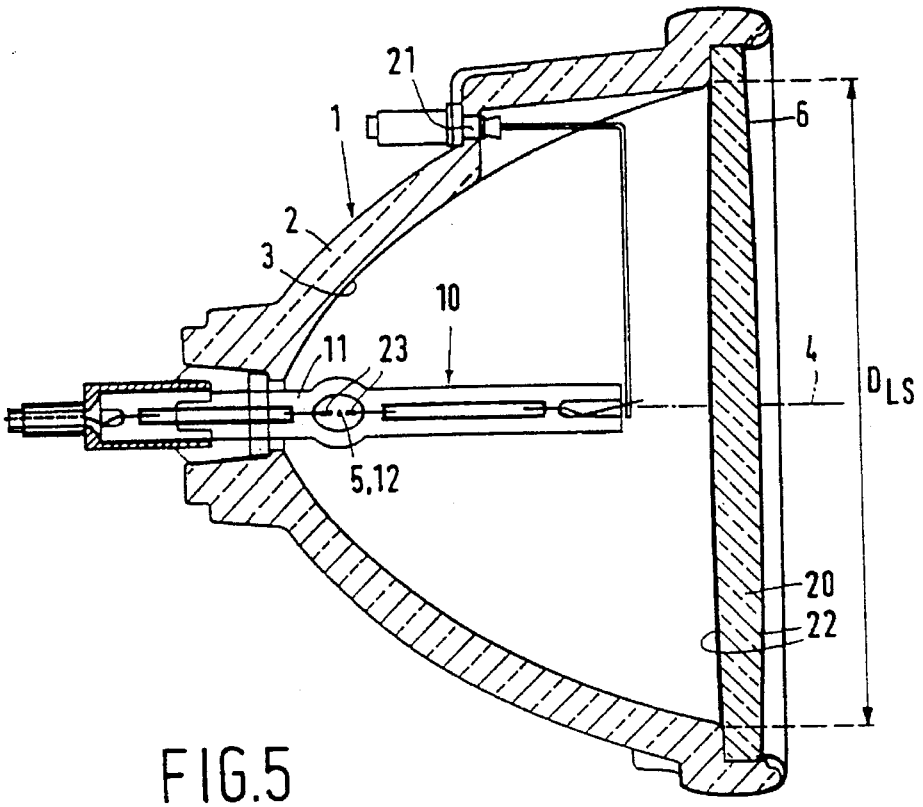
FIG. 5 is an axial cross-section of an embodiment of the lamp with reflector.

In FIG. 5, the electric lamp with reflector has a reflector 1 with a reflector body 2 which has a concave reflecting surface 3, chosen from surfaces of ellipsoidal and surfaces of paraboloidal general shape, an optical axis 4, a focus 5 inside the reflector, and a light emission window 6.

The electric lamp 10 has a lamp vessel 11 which is closed in a vacuumtight manner and in which a linear electric element 12 is present, positioned on the optical axis 4.

Figure 1:
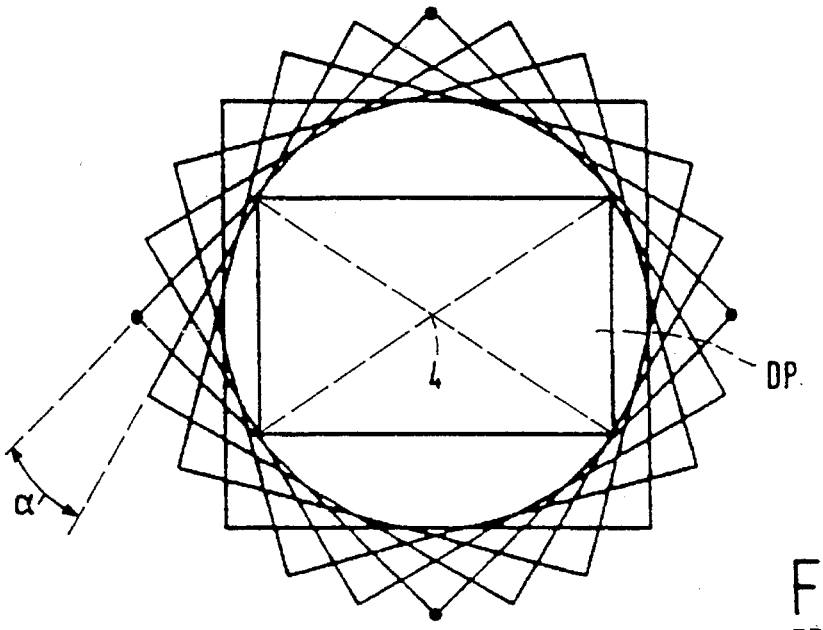
FIG. 1 PRIOR ART
FIG. 1 shows the pattern of a field illuminated with a known reflector.
Figure 2:
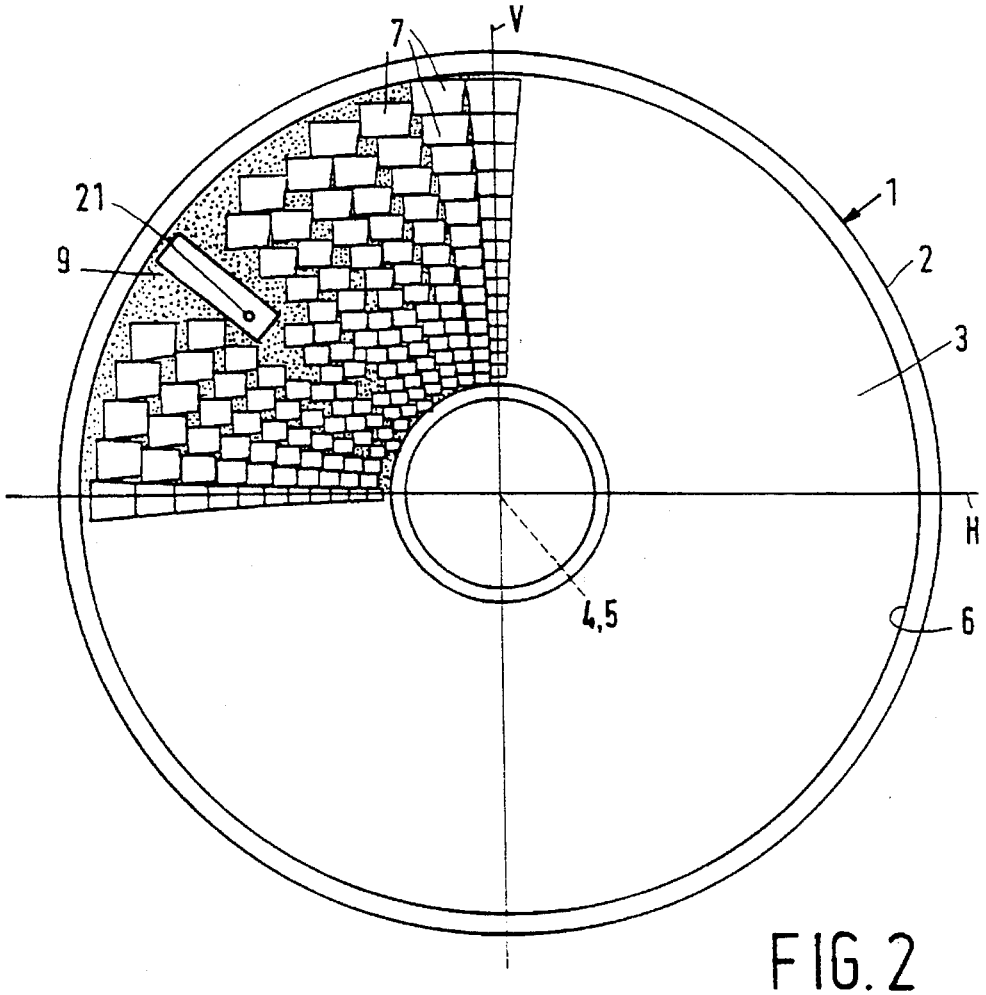
FIG. 2 is the axial aspect of a quadrant of a reflector according to the invention.
Figure 3:
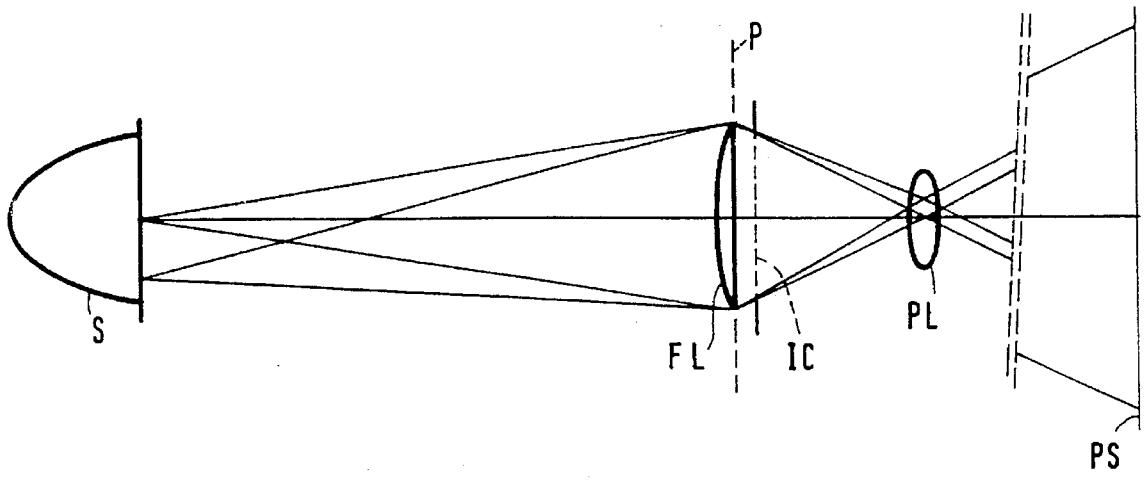
FIG.3 PRIOR ART
FIG. 3 shows the basic principle of a projection apparatus.
Figure 6:
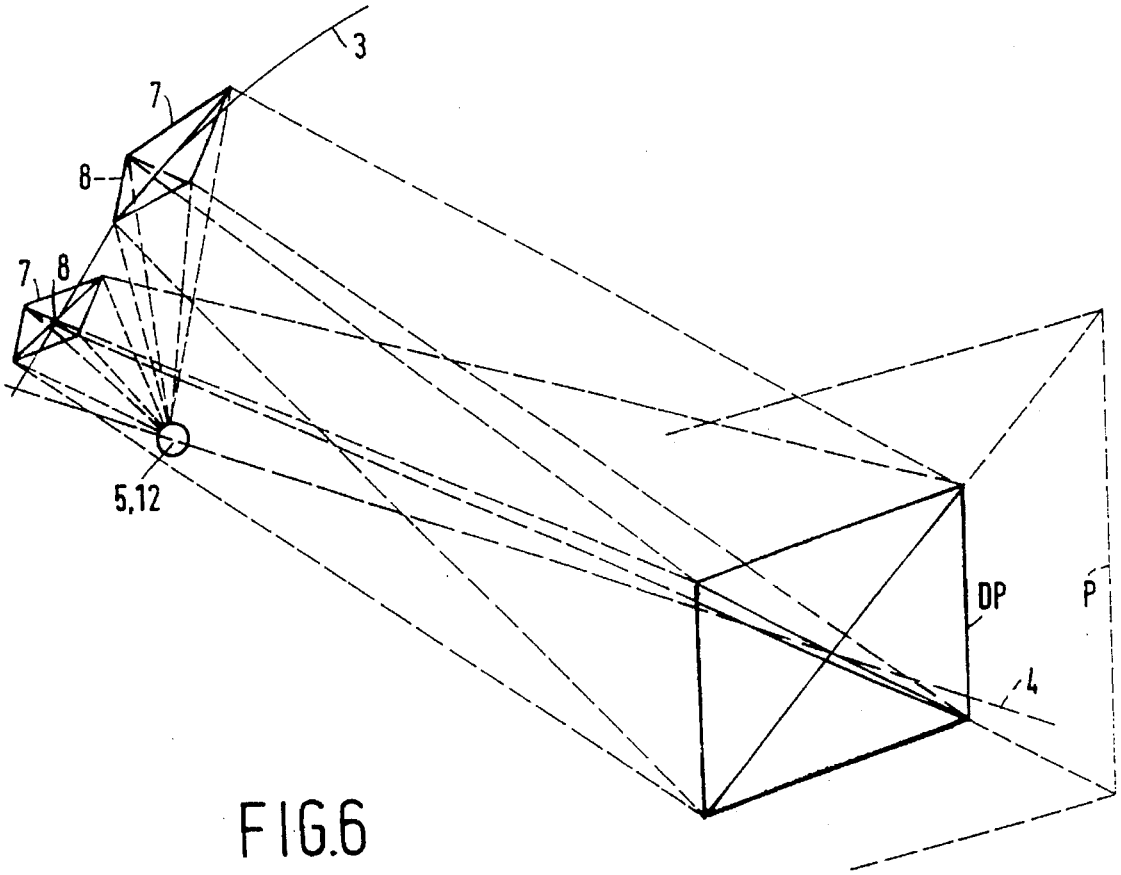
FIG. 6 shows a detail of the passage of rays in an alternative embodiment.

The reflector 1 is shown to be smooth in the Figure, but in actual fact it has a reflecting surface 3 which is substantially built up from substantially plane, substantially quadrangular reflecting facets 7 superimposed on the general shape, as shown in FIG. 2, each with a point of tangency 8 to the concave general shape, see FIG. 6. The facets 7 each illuminate a field DP in a plane P at a distance from the light emission window 6 perpendicular to the optical axis 4, which field is substantially of the same shape and size for each facet and has the same orientation. The light emission window 6 has a diameter $D_{LS}$ and the electric element 12 has an axial dimension L, $D_{LS}/L$ being greater than 40.

In the embodiment shown, the reflecting surface has a paraboloidal general shape and $D_{LS}$ is 75 mm. The electric element 12, a discharge path of a high-pressure mercury discharge with a working pressure of approximately 200 bar or more in the Figure, is arranged in the focus 5 of the reflector 1. The lamp 10 consumes a power of approximately 100 W. The electric element, the discharge path between electrodes 23, has an axial length L of 1.4 mm, so that the ratio $D_{LS}/L$ in the embodiment shown is approximately 53. Alternatively, a similar lamp was indetachably fastened in a similar reflector, consuming a power of approximately 130 W and having a length L of 1.8 mm, so that the ratio was 41.7. In another similar reflector with $D_{LS}$ =100 mm, the ratios were approximately 71 and approximately 56, respectively, upon the application of these lamps.

In the embodiment shown, the points of tangency 8 of the facets 7 lay in the geometric centers thereof (see FIG. 6), i.e. the points of intersection of their diagonals.

The regions 9 (see FIG. 2) between facets 7 are light-scattering.

A current conductor 13 extending to the electric element 12 passes to the exterior through an opening 21 (see also FIG. 2) in the reflector body 2 in a region 9 between facets 7.

A transparent plate 20 closes the light emission window 6. In FIG. 5, the plate 20 is optically active and constructed as a positive extra lens EL which is incorporated in the light emission window. The lens accordingly has a diameter $D_{EL}=D_{LS}$. The lens has an anti-reflection coating 22 on both surfaces, for example, a $\lambda/4$ layer of $MgF_2$, $\lambda$ being a wavelength in the visible portion of the spectrum, for example, 575 nm.

Figure 4:
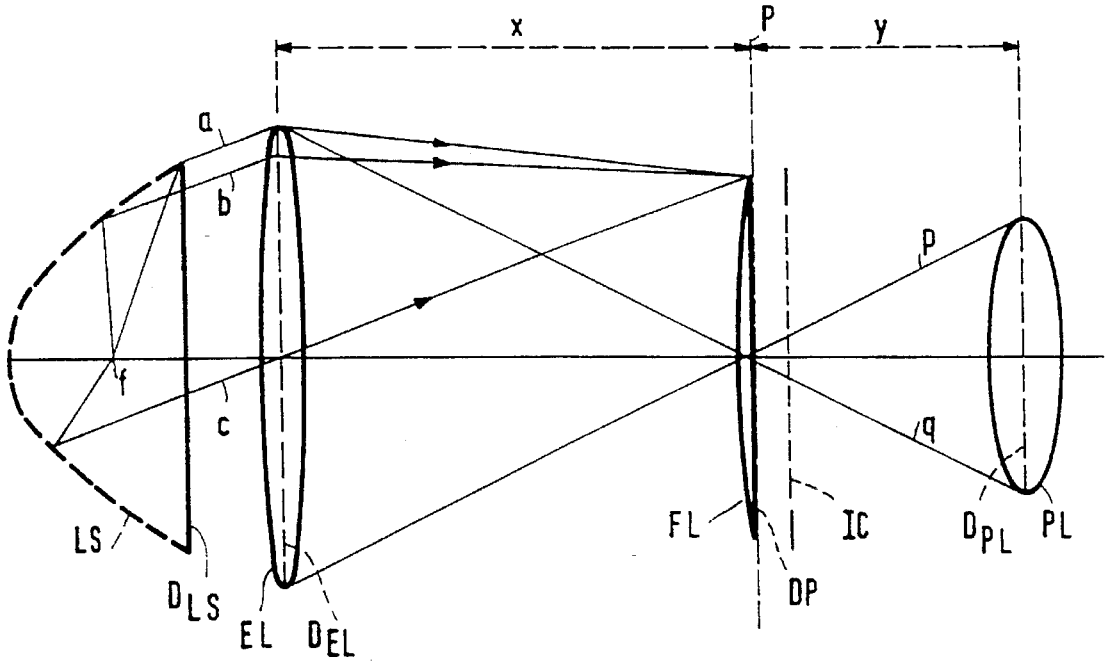
FIG. 4 shows the passage of rays in an embodiment of the lamp with reflector according to the invention.

In FIG. 6, the reflecting surface has an ellipsoidal general shape. The linear light source 12 is arranged axially in the focus 5. The facets 7 have their points of tangency 8 to the general shape in their respective geometric centers. They each illuminate individually a substantially rectangular field DP in plane P. The fields DP of all facets 7 are substantially of the same shape and size, and also of the same orientation. In the Figure, the fields DP fully coincide. Alternatively, if the reflecting surface were to have a paraboloidal basic shape, the fields DP of the various facets would have been mutually shifted in the plane P, but they would indeed have had the same orientation (cf. FIG. 4). In the embodiment of FIG. 5, the positive extra lens EL then causes the fields to coincide on the axis 4.

We claim:

1. An electric lamp with reflector, comprising:

a reflector having a reflector body with a concave reflecting surface chosen from surfaces with an ellipsoidal and surfaces with a paraboloidal general shape, an optical axis, a focus within the reflector, and a light emission window;

an electric lamp with a lamp vessel which is closed in a vacuum tight manner and in which a linear electric element is present, arranged on the optical axis, characterized in that the reflecting surface mainly comprises substantially planar, substantially quadrangular reflecting facets superimposed on the general shape, which facets each have a point of tangency to the concave general shape and each individually illuminate a substantially quadrangular field in a plane at a distance from the light emission window, perpendicular to the optical axis which field is substantially of the same shape and size for each facet and has the same orientation, and the light emission window has a diameter $D_{LS}$ and the electric element has an axial dimension L, $D_{LS}/L$ being greater than 40.

2. An electric lamp with reflector as claimed in claim 1, characterized in that the point of tangency of each facet coincides substantially with the geometric center thereof.

3. An electric lamp with reflector as claimed in claim 2, characterized in that regions situated in between facets are light-scattering.

4. An electric lamp with reflector as claimed in claim 2, characterized in that a current conductor to the electric element passes through an opening in the reflector body in a region in between facets.

5. An electric lamp with reflector as claimed in claim 2, characterized in that a transparent plate closes the light emission window.

6. An electric lamp with reflector as claimed in claim 5, characterized in that the transparent plate is optically active.

7. An electric lamp with reflector as claimed in claim 6, characterized in that the transparent plate has an anti-reflection coating.

8. An electric lamp with reflector as claimed in claim 7, characterized in that the reflecting surface has a paraboloidal general shape, the electric element is positioned in the focus, and the transparent plate is a positive lens.

9. An electric lamp with reflector as claimed in claim 1, characterized in that regions situated in between facets are light-scattering.

10. An electric lamp with reflector as claimed in claim 1, characterized in that a current conductor to the electric element passes through an opening in the reflector body in a region in between facets.

11. An electric lamp with reflector as claimed in claim 1, characterized in that a transparent plate closes the light emission window.

12. An electric lamp with reflector as claimed in claim 6, characterized in that the reflecting surface has a paraboloidal general shape, the electric element is positioned in the focus, and the transparent plate is a positive lens.

13. An electric lamp according to claim 1, wherein the substantially quadrangular field illuminated by each said facet has an aspect ratio of one of (i) 4/3 and (ii) 16/9.

14. A reflector lamp, comprising:

a reflector body having a concave reflecting surface with a general shape selected from the group consisting of ellipsoidal and paraboloidal surfaces, said reflector body having an optical axis, a focus within the reflector body and a light emission window with a diameter $D_{LS}$, said reflecting surface mainly comprising substantially plane reflecting polygonal facets superimposed on said concave general shape and each having a point of tangency to said concave general shape, each said facet individually illuminating a polygonal field in a plane spaced from the light emission window, which polygonal field is substantially of the same size and shape for each respective facet and has substantially the same orientation; and a linear light source aligned with the optical axis, said light source having an axial length dimension L selected such that the ratio $D_{LS}/L$ is greater than 40.

15. A lamp reflector, comprising:

a reflector body having a concave reflecting surface with a general shape selected from the group consisting of ellipsoidal and paraboloidal surfaces, said reflector body having an optical axis, a focus within the reflector body and a light emission window, said reflecting surface mainly comprising substantially plane polygonal reflecting facets superimposed on said concave general shape and each having a point of tangency to said concave general shape, each said facet individually illuminating a polygonal field in a plane spaced from the light emission window, which polygonal field is substantially of the same size and shape for each respective facet and has substantially the same orientation.

16. A lamp reflector according to claim 15, wherein said facets, and said field illuminated by each facet, is substantially quadrangular.

17. A lamp reflector according to claim 15, wherein the substantially quadrangular field illuminated by each said facet has an aspect ratio of one of (i) 4/3 and (ii) 16/9.

18. An electric lamp with reflector as claimed in claim 15, characterized in that the point of tangency of each facet coincides substantially with the geometric center thereof.

19. An electric lamp with reflector as claimed in claim 15, characterized in that regions situated in between facets are light-scattering.

20. An electric lamp with reflector as claimed in claim 15, characterized in that a transparent plate closes the light emission window.

21. An electric lamp with reflector as claimed in claim 20, characterized in that the transparent plate is optically active.

22. An electric lamp with reflector as claimed in claim 20, characterized in that the transparent plate has an anti-reflection coating.

23. An electric lamp with reflector as claimed in claim 20, characterized in that the reflecting surface has a paraboloidal general shape, the electric element is positioned in the focus, and the transparent plate is a positive lens.

24. A projection system, comprising:

a) a reflector lamp, said reflector lamp comprising a reflector body having a concave reflecting surface with a general shape selected from the group consisting of ellipsoidal and paraboloidal surfaces, said reflector body having an optical axis, a focus within the reflector body and a light emission window with a diameter $D_{LS}$, said reflecting surface mainly comprising substantially plane reflecting facets superimposed on said concave general shape and each having a point of tangency to said concave general shape, each said facet individually illuminating a field in a plane spaced from the light emission window, which field is substantially of the same size and shape for each respective facet and has substantially the same orientation; and a linear light source aligned with the optical axis, said light source having an axial length dimension L selected such that the ratio $D_{LS}/L$ is greater than 40;

b) a field lens spaced from the light emission window;

c) an image carrier spaced from said field lens for imparting image information to light from the reflector lamp passing through the field lens; and d) a projection lens for projecting the image from the image carrier.

25. A projection system according to claim 24, wherein the general shape of said reflecting surface is parabaloidal whereby the fields illuminated by said facets do not substantially coincide, said system further including an extra lens situated between said reflecting surface and said field lens for causing the respective fields of said facets to coincide at said field lens.

26. A projection system according to claim 25, wherein said projection lens has a diameter $D_{PL}$ and a focal length $F_{PL}$, said extra lens has a diameter $D_{EL}$ and a focal length $F_{EL}$ substantially equal to $F_{PL} * (D_{el}/D_{PL})$.

27. A projection system according to claim 25, wherein said diameter $D_{EL}$ is equal to the diameter of the light emission window of said reflector body.

28. A projection system according to claim 27, wherein said extra lens closes the light emission window of the reflector body.

* * * * *